US007980382B2

(12) United States Patent
De Greef

(10) Patent No.: US 7,980,382 B2
(45) Date of Patent: Jul. 19, 2011

(54) GUIDING, DISTRIBUTING AND FILLING DEVICE, AND METHOD FOR USE THEREOF

(75) Inventor: Jacob Hendrik De Greef, Waardenburg (NL)

(73) Assignee: De Greef's Wagen-, Carrosserie- en Machinebouw B.V., Tricht (NL)

( * ) Notice: Subject to any disclaimer, the term of this patent is extended or adjusted under 35 U.S.C. 154(b) by 746 days.

(21) Appl. No.: 11/587,839

(22) PCT Filed: Apr. 28, 2005

(86) PCT No.: PCT/NL2005/000323

§ 371 (c)(1),
(2), (4) Date: Aug. 31, 2007

(87) PCT Pub. No.: WO2005/105576

PCT Pub. Date: Nov. 10, 2005

(65) Prior Publication Data

US 2008/0066429 A1 Mar. 20, 2008

(30) Foreign Application Priority Data

Apr. 28, 2004 (NL) ..... 1026073

(51) Int. Cl.
*B65G 37/00* (2006.01)
*B65B 25/04* (2006.01)
*B65B 25/02* (2006.01)

(52) U.S. Cl. ..... 198/580; 198/341.09; 53/443; 53/534; 53/244

(58) Field of Classification Search ..... None
See application file for complete search history.

(56) References Cited

U.S. PATENT DOCUMENTS

| | | | | | |
|---|---|---|---|---|---|
| 4,135,346 | A | * | 1/1979 | Rebsamen | 53/494 |
| 4,194,343 | A | | 3/1980 | Myers et al. | |
| 4,323,178 | A | * | 4/1982 | Longinotti | 222/415 |
| 4,446,670 | A | | 5/1984 | Compagnoni | |
| 5,062,369 | A | * | 11/1991 | Cobden et al. | 105/396 |
| 5,772,004 | A | | 6/1998 | Main | |
| H1747 | H | * | 9/1998 | Saeki et al. | 53/443 |
| 6,148,989 | A | * | 11/2000 | Ecker | 198/387 |

(Continued)

FOREIGN PATENT DOCUMENTS

| | | |
|---|---|---|
| EP | 0858949 | 8/1998 |

(Continued)

*Primary Examiner* — Gene Crawford
*Assistant Examiner* — Kavel Singh
(74) *Attorney, Agent, or Firm* — Meyertons, Hood, Kivlin, Kowert & Goetzel, P.C.; Eric B. Meyertons

(57) ABSTRACT

The present invention relates to a method for uniformly filling a relatively large container (5) with relatively delicate products, wherein the products are supplied at a first level using a feed conveyor (17), and these products are transferred by means of a guiding device which guides the products in restrained manner from the first level to a second level, wherein at the second level the products are released into a distributing device (3) for distribution in the container. The invention further relates to a guiding device (2) for guiding products from a feed conveyor, comprising: —at least one transfer member (11) comprising means for receiving the products at a speed which can be adjusted to the speed of the feed conveyor, —a guide member (12) which is arranged substantially along a part of the outside of the transfer member for guiding the products in the transfer member.

18 Claims, 5 Drawing Sheets

U.S. PATENT DOCUMENTS 6,644,905 B1 * 11/2003 Peterson et al. ..... 414/295

FOREIGN PATENT DOCUMENTS

| | | |
|---|---|---|
| FR | 2686314 | 7/1993 |
| FR | 2696151 | 4/1994 |
| FR | 2753683 | 3/1998 |
| FR | 2834690 | 7/2003 |
| GB | 1031334 | 6/1966 |
| NL | 1001697 | 11/1996 |
| NL | 8304373 | 7/2007 |
| WO | 00/12415 | 3/2000 |

* cited by examiner

GUIDING, DISTRIBUTING AND FILLING DEVICE, AND METHOD FOR USE THEREOF

In the field of handling delicate products, such as vegetables and fruit, and of sorting thereof, use is usually made of conveyors for transferring thereof.

Particularly in the case of delicate products it is important that they are damaged or bruised as little as possible. A vertical distance must for instance be bridged in order to fill a relatively large container such as a large case. So-called vertical finger conveyors are applied here in known manner. Products are herein supplied over a substantially horizontal feed belt from which the fruits drop at the end. They are then caught by a vertical conveyor belt from which protrude horizontal, so-called fingers. These fingers break the fall and the products are released at the bottom of the vertical conveyor. Such vertical finger conveyors have at least the drawback that fruits approaching at a horizontal speed are slowed abruptly by the vertical conveyor belt, which can cause damage or bruising. The fruits are subjected abruptly to a change in direction from a horizontal direction to a vertical direction. The fruit further undergoes an abrupt vertical change in speed when leaving the vertical conveyor belt, which can cause bruising.

In order to obviate such drawbacks, the present invention provides a method for uniformly filling a relatively large container with relatively delicate products, wherein the products are supplied at a first level using a feed conveyor, these products are transferred by means of a guiding device which guides the products in restrained manner from the first level to a second level, and wherein these products are placed in the container. The products can hereby be placed gently in a container, which prevents bruising of the products.

A preferred embodiment according to the invention relates to a guiding device for guiding products from a feed conveyor, comprising:

- at least one transfer member for receiving the products at a speed which can be adjusted to the speed of the feed conveyor,
- a guide member which is arranged substantially along a part of the outside of the transfer member for guiding the products in the transfer member.

Such an embodiment has the advantage that the products are received at the horizontal speed at which they leave the feed conveyor, whereby bruising of or damage to the products is prevented. Such a guiding device further has a simpler structure than the known finger conveyor, whereby it can be manufactured and maintained in cost-efficient manner.

A further drawback of the finger conveyor is that at a high level of utilization a jamming phenomenon occurs in the space between the feed conveyor and the finger conveyor, whereby damage occurs. The guiding device is very suitable for such a high level of utilization, whereby the guiding device need be in operation for relatively short periods of time, which can minimize wear or damage due to flap, as will be described herein below.

In a first preferred embodiment, the transfer member has a substantially cylindrical form. Products can hereby be transferred which are supplied over a feed conveyor with a certain width.

The transfer member preferably comprises product-friendly receiving means. Possible damage or bruising due to a vertical speed component is hereby prevented, and damage or bruising due to a small variation in the horizontal speed is also prevented.

A suitable transfer member preferably comprises bristles. In such an embodiment the products are received by the bristles during transfer of the products. In a further embodiment the guiding device comprises bristles of differing length. Due to such an increasing density of the bristles as seen from the outer end of the bristles in the direction of the point of implantation thereof, a product can be caught gradually. With for instance an implantation of bristles of two lengths the longer, thinner implanted bristles will move apart relatively easily when receiving a product for a very gentle catching of the product, and the product will be slowed further when it reaches the more densely implanted, shorter layer of bristles. The products are hereby received by the transfer member in very gentle manner.

The guiding device preferably comprises a cleaning member for cleaning or combing the bristles. The brush hereby remains in good condition for a long period.

In a further preferred embodiment, the guiding device comprises a flap which substantially extends at least partly along the surface of the transfer member. Due to the transferring transport by means of the transfer member the products are moved forward such that they will fall out of the transfer member. In order to postpone this fall of the products out of the transfer member to a height which is as favourable as possible for the product, the products are guided downward along the flap and for instance between bristles so that they are released therefrom in very gentle manner.

A further aspect of the present invention relates to a distributing device for uniformly distributing a number of products in a container, comprising:

- a first rotating distributor comprising flaps for carrying the products,
- a second distributor arranged below the first rotating distributor and comprising at least one opening for passage of the products,
- wherein the first rotating distributor comprises more flaps on the outer side than on the inner side.

Such a distributing device has the advantage that relatively short or relatively simple flaps can be applied for releasing products into the container without damage or bruising. In such a distributing device the first rotating distributor preferably comprises pins which extend substantially as a spoke of the first rotating distributor, and distributing pins which extend from the outside to the inside over a part of the first rotating distributor, wherein the flaps can be fixed to these pins. This embodiment has the advantage that in simple manner more flaps can be arranged on the outer side than on the inner side.

The distributing pins are preferably attached resiliently to the first rotating distributor, or these pins take a resilient form. This has the advantage that if a product becomes jammed between a distributing pin and the second distributor, possible damage to the product will be limited. For instance in the case of an apple, crushing or heavy damage to the apple, which would result in undesirable contamination of the device, is prevented. The materials of the discs are chosen such that the g-forces are minimized, for instance by soft materials.

In a further preferred embodiment, the distributing device comprises height-adjusting means for setting the height of the distributing device relative to the container. For careful filling of the container it is recommended that the distance between the underside of the second distributor and the bottom of the container, or the upper side of the products already placed in the container, is relatively small. This prevents falling of the products. Too small a distance is likewise undesirable in respect of damage to products already present. For this purpose the underside of the second distributor is preferably provided with a detector which indicates too small a distance, whereafter the container is moved to a lower position relative to the underside of the distributing device.

In order to facilitate release of the products in gentle manner from the second rotating distributor, and/or gentle distribution of the products in gentle manner over the container, the second distributor comprises a distributing flap. This preferably has a length such that all corners of the container can be reached.

A further aspect of the present invention relates to a filling device, comprising a guiding device as described in the foregoing for filling a container with delicate products such as vegetables and fruit. In a practical embodiment, the flap is relatively long for the purpose of distributing products in a container rotating below the guiding device.

This filling device preferably comprises a distributing device as specified in the foregoing. This distributing device can be used to distribute the products over the container.

Using such a filling device, containers such as relatively large cases can be filled with delicate products such as fruits, with the advantages as specified in the foregoing.

During the discharge of products from the guiding device to the distributing device, bruising is prevented by adjusting the relative speeds to each other.

A further aspect of the present invention relates to a method for filling a container making use of devices as specified in the foregoing.

In a first preferred embodiment hereof, at least the second distributor is stopped during filling of the container if there is no supply of fruits. A continuous dragging of flaps, and in particular the distributing flap, over the fruit already present in the container is hereby prevented. Energy is further saved.

In a further preferred embodiment, the speed of at least the second distributor is varied depending on the degree of filling of the container. This has the advantage that, for instance when the first layer of products is arranged in the container, the machine can be set to a relatively slow speed, whereby contact of the products with the hard bottom of the container will be relatively gentle, whereby damage and/or bruising are prevented. Once sufficient products have been arranged in the container to provide the entire bottom of the container with a layer of products, the speed can be increased in order to increase the efficiency of the machine.

In a further preferred embodiment, the feed conveyor is filled gradually or step-wise with a batch of products, and is then emptied quickly via the guiding device and/or the distributing device. The time for which the distributing flap in particular scrapes over the products in the container is hereby reduced. Further advantages, features and details of the present invention will be further explained with reference to the accompanying figures, wherein it must be noted that different aspects of different embodiments can be varied freely. In the drawing.

Figure 1:
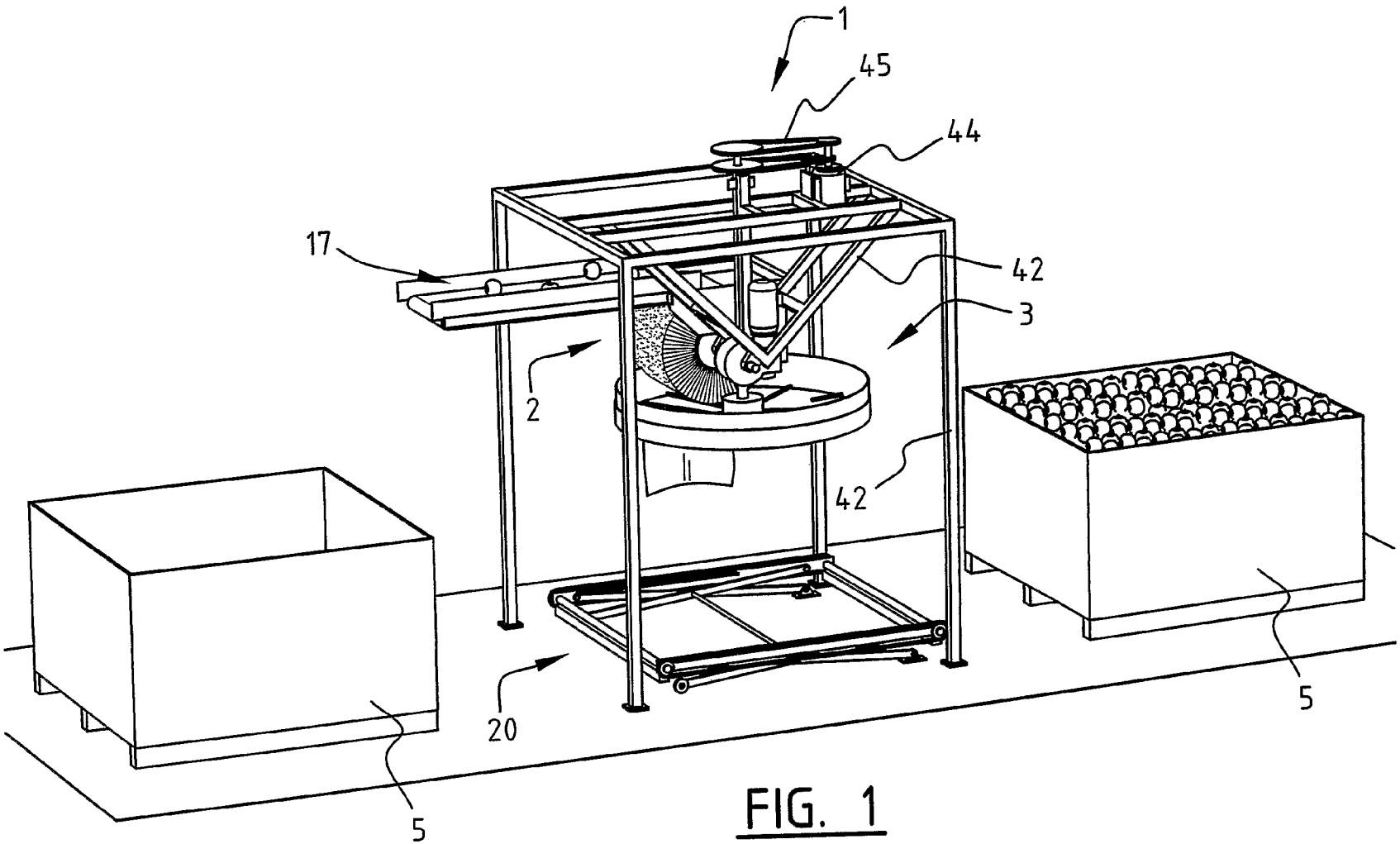
FIG. 1 shows a perspective view of a preferred embodiment according to the present invention.
Figure 2:
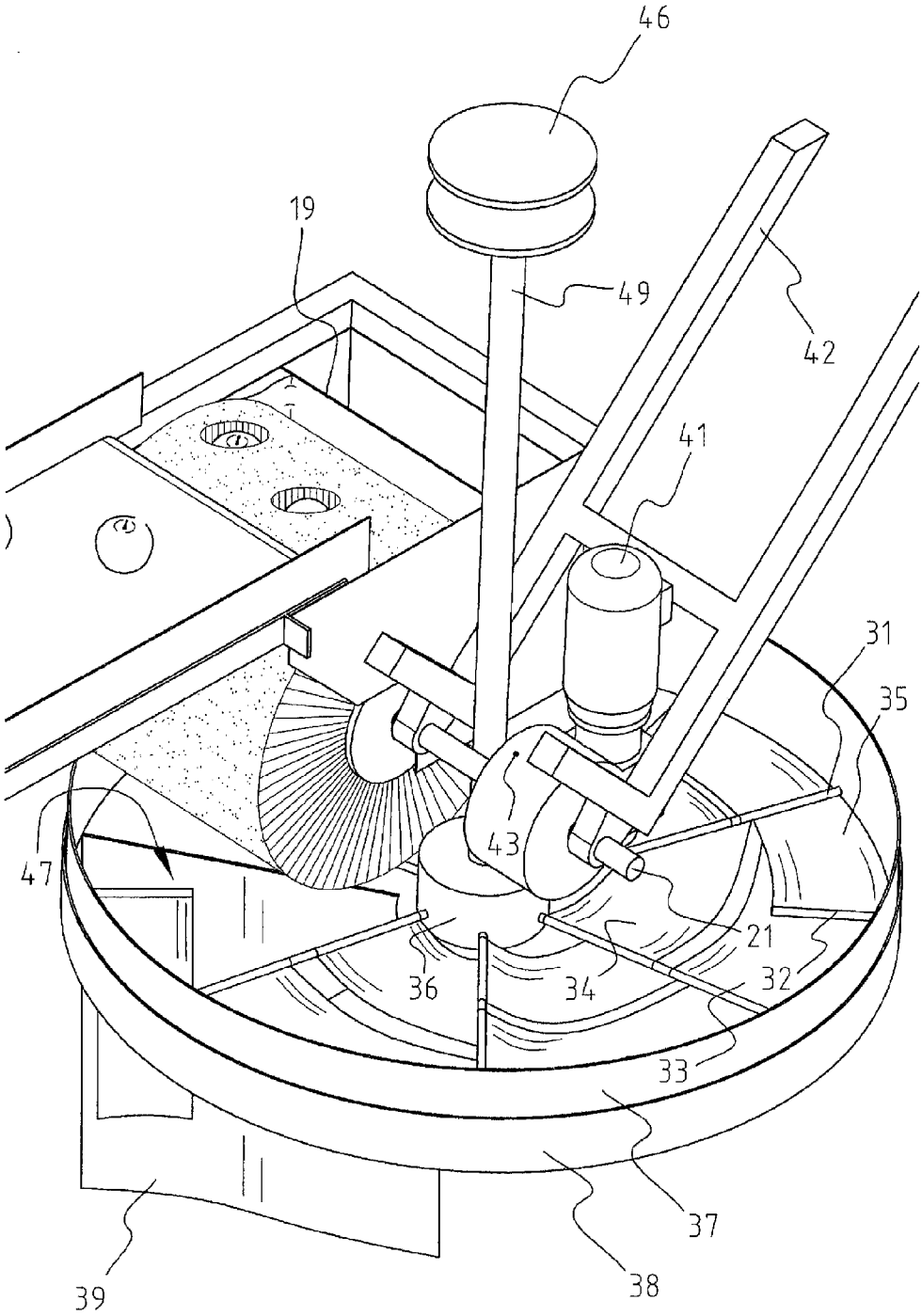
FIG. 2 shows a detail in perspective of the embodiment of FIG. 1.
Figure 3:
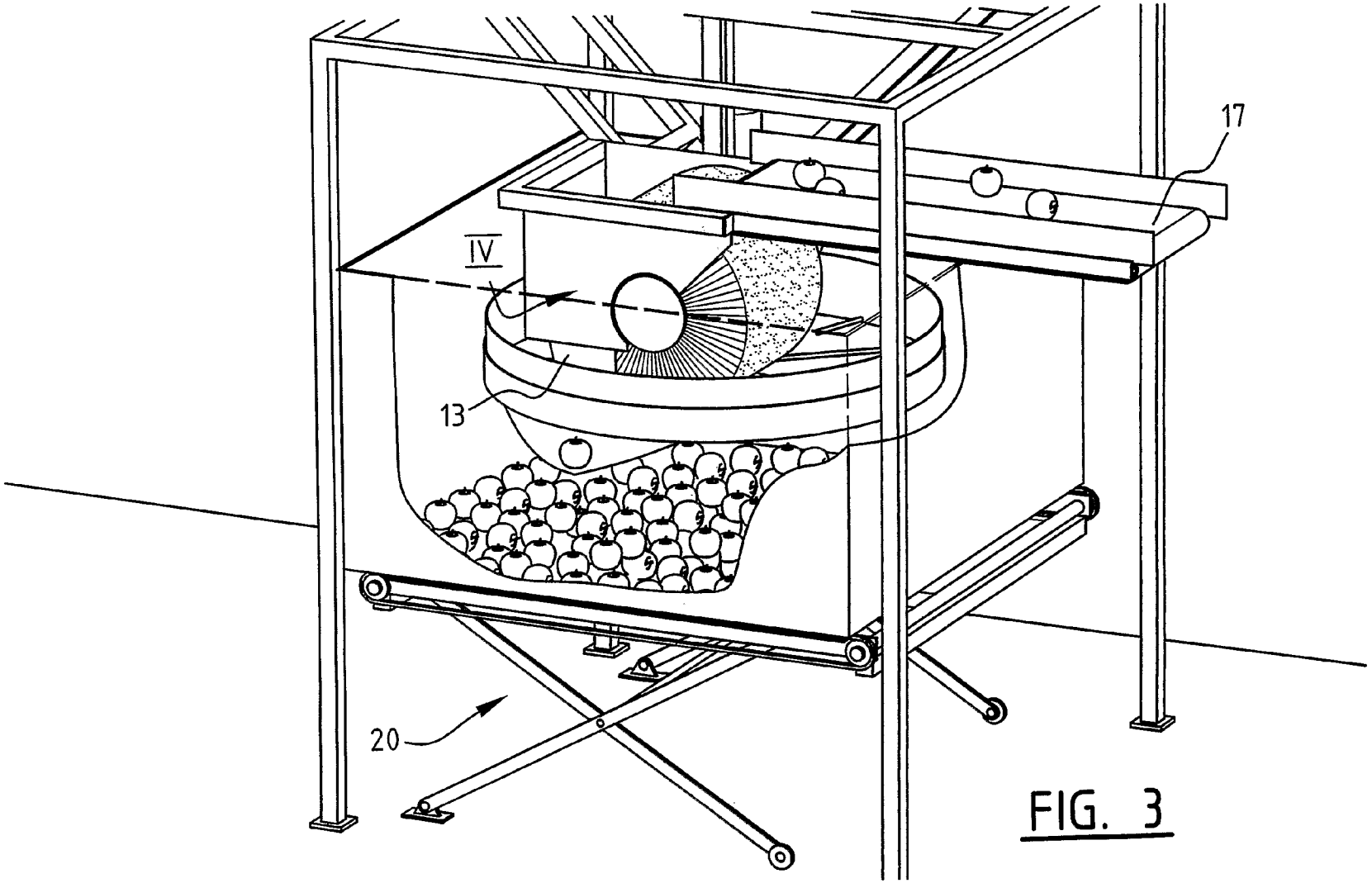
FIG. 3 shows a partly cut-away detail view of the embodiment of FIG. 1.
Figure 4:
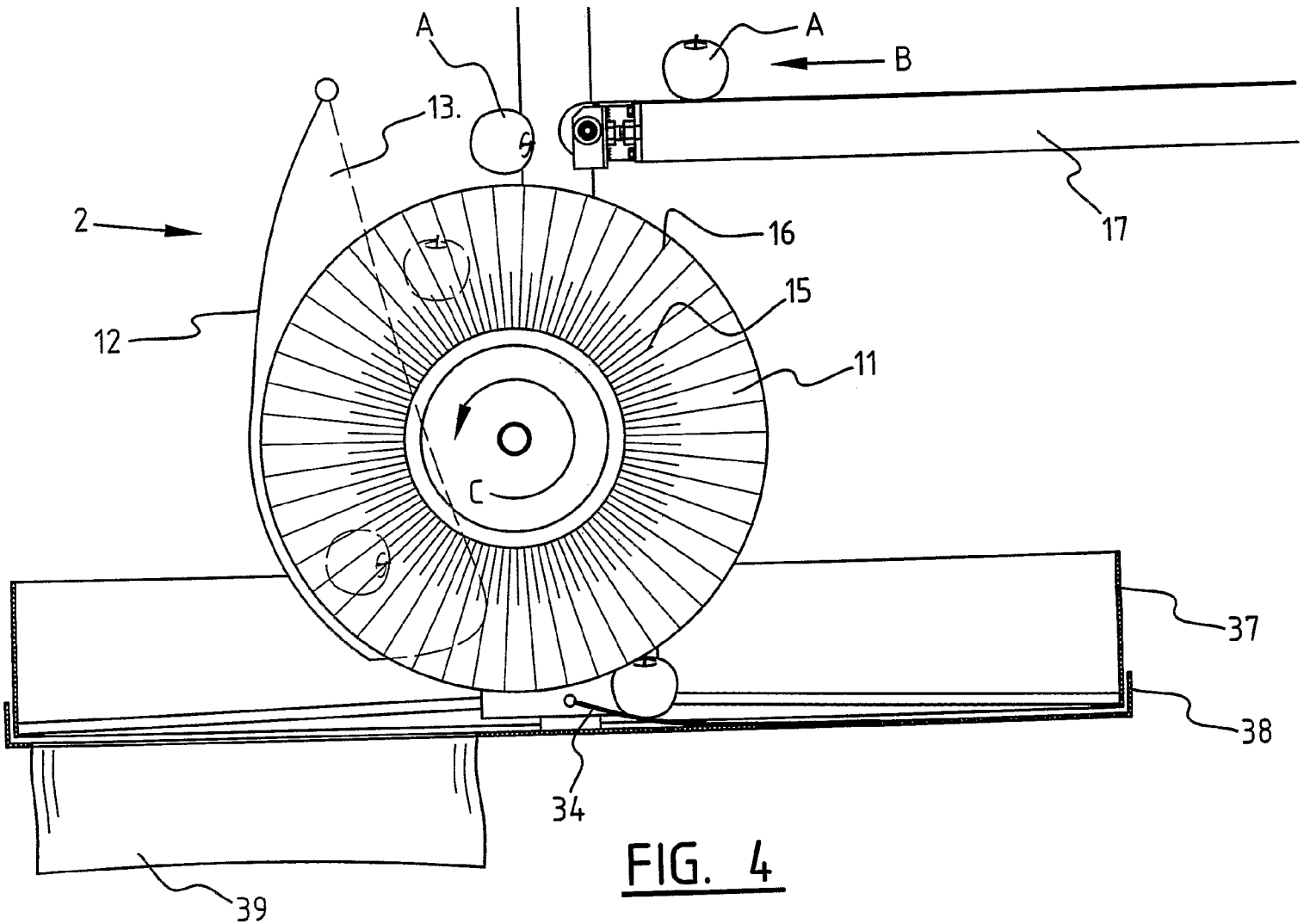
FIG. 4 is a cut-away side view of a detail of the embodiment of FIG. 1.

FIG. 1 shows an embodiment of a filling device 1 according to the present invention. Details of embodiments of a filling device are shown in FIGS. 2, 3 and 4. Filling device 1 is intended for uniform filling of cases 5 with delicate products such as for instance vegetables or fruit. Such a case is placed for this purpose on a lifting device 20 which can hold the case at different heights under filling device 1. An alternative is that the case is placed at a fixed height on a support or table and that the filling device is varied in height. Different variations of lifting devices are possible; it can for instance be an independent platform, but can also be embodied as part of frame 42. Between harvesting and sale to consumers such cases are for instance used as intermediate storage and usually have a volume of 300-1500 liters. 200-800 kilos of product are for instance stored therein.

The device provides a feed conveyor 17 for supplying for instance apples A. These apples are transferred via a guiding device 2 to a distributing device 3. From distributing device 3 the apples are distributed uniformly in case 5.

Guiding device 2 is shown clearly in side view in FIG. 4. Brush 11 is formed by means of bristles 15 and 16. Bristles 16 are longer than bristles 15. This results in a brush which moves apart relatively easily on the outside and which is somewhat firmer on the inside. Guiding device 2 further comprises a flap 12 which is attached on the top by means of rod 19. This flap extends downward from this rod, whereafter it fits in cylindrical shape round the surface of the brush. This flap can also extend beyond the lowest point of the brush, wherein the flap extends beyond this lowest point in horizontal direction.

The apples are fed by means of conveyor belt 17 in the direction of arrow B. At the end of the conveyor belt the apples drop slightly downward, wherein they are caught by the bristles. Owing to the nature of the bristles, this catching takes place in very gentle manner. The brush preferably rotates in the direction of arrow C. The speed of the brush is hereby adjusted to the forward speed of the apple, whereby it is received by the brush without a speed jolt. The apple is guided downward by the rotation of the brush. The apple will hereby gradually fall back to the surface of the brush and be guided downward along flap 12. At the end of the flap the apple is released from guiding device 2. Alternatively, the brush can rotate in the other direction, wherein the difference in speed is absorbed by the flexibility of the bristles.

The brush is driven by motor 41, which drives drive shaft 21 of the brush by means of a transmission 43. This suspension of the brush is mounted in frame 42 of filling device 1.

The apple then comes to lie in distributing device 3. This distributing device 3 comprises first and second distributors 37 and 38, the first distributor located above the second distributor. Examples of a distributor include, but are not limited to, a disc and a dish. First distributor 37 is provided with radial spokes 31 and 32 on which are fastened flaps 33, 34, 35.

An opening 47 is situated in the second distributor 38. On the front side of this opening 47, as seen in the direction of rotation, is attached distributing flap 39. This relatively long flap can be flat or curved and extends into or close to the corners of the large case.

The first distributor 37 comprises inner flaps 34 and outer flaps 33 and 35. For fixing of the outer flaps 35 there is provided a short spoke 32 which is fixed to the outer edge of first distributor 37. By placing such short spokes between the whole spokes it is possible to apply more flaps on the outer side of the disc than on the inner side of the disc. A relatively good protection of the apples is hereby achieved. These narrower flaps are also easier to guide out of opening 47, which will be further discussed herein below.

The operation of distributing device 3 is based on the principle that the apples come to lay spread on the flaps of the first distributor because of the rotation of this distributor and the distribution in the supply of the apples. The first distributor then rotates at a speed other than the second distributor, whereby the flaps with the apples thereon will arrive successively above opening 47 of the second distributor. When this happens the flaps and the apples will drop through opening 47 and the apples will come to lay on the large flap 39. The apples will then be distributed in the case from this flap. Because the second distributor rotates at a determined speed, the apples will be distributed uniformly over a layer in the case. The case will hereby be filled layer by layer. By arranging short radial pins 32 with flaps thereon on the outer side of first distributor 37 the flaps can be given a short form on the outer side. Relatively short flaps can hereby be applied on the outer side of the distributor and less friction occurs when the relatively short flap is withdrawn from opening 47.

The first and second distributors are driven by means of a motor 44, which drives a chain 45. The chain drives a toothed wheel 46 on an outer end of a shaft 49. By means of a transmission in the central bushing 36 of both discs the shaft 49 drives the first and second distributors at a mutually differing speed.

A further embodiment (FIG. 5) relates to a guiding device 51 which releases directly into the case. This guiding device 51 is provided for this purpose with a long flap 52. The case is further positioned for rotation in the direction of arrow E under guiding device 51. All corners of the case can hereby be reached using the long flap.

The long flap 52 extends from fastening pin 54 to a position relatively far beyond rotating brush 11 in order to reach the corners of the case. The flap is further provided with guiding side walls 53.

Figure 6:
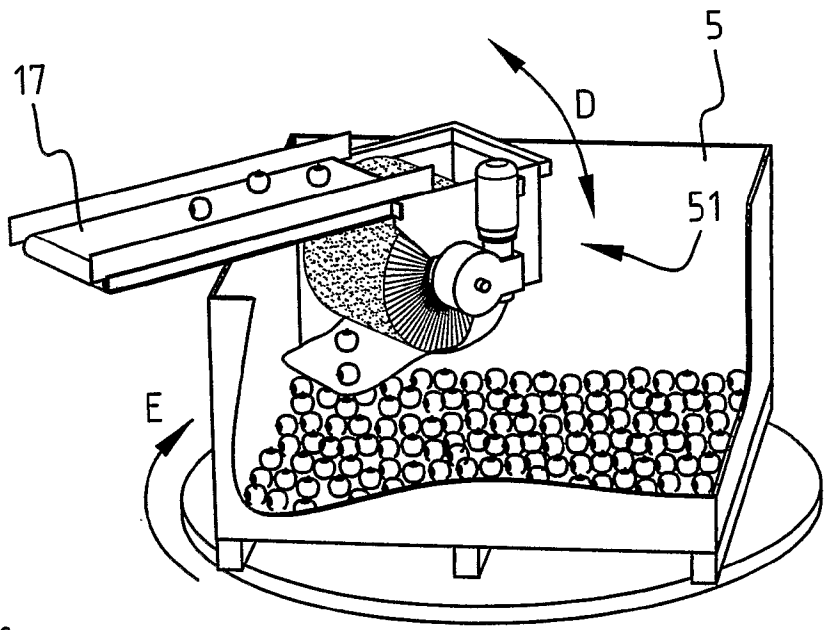
FIG. 6 shows a schematic perspective view of a further embodiment according to the present invention.
Figure 5:
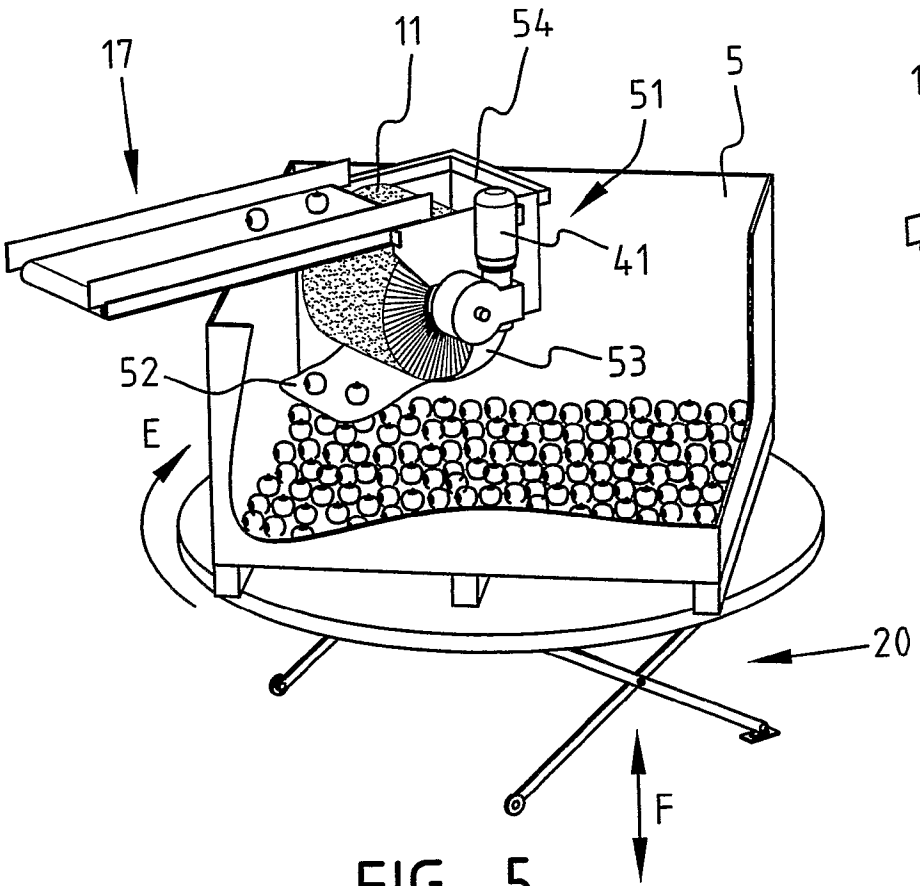
FIG. 5 is a schematic perspective view of a further embodiment according to the present invention.

In the embodiment of FIG. 5, feed conveyor 17 and guiding device 51 are stationary and the case can be varied in height in the directions of arrow F. In the embodiment of FIG. 6 the case is likewise disposed rotatably, although here at a fixed height. In this embodiment guiding device 51 with conveyor belt 17 is height-adjustable. The start of the feed conveyor can herein pivot so that the feed height of the conveyor remains the same as fruit supply. Thus, the transport angle of the feed conveyor relative to the guiding device is adjustable.

The present invention is not limited to the described embodiments. Different aspects of the embodiments can be varied relative to each other. The invention is defined by the content of the appended claims.

The invention claimed is:

1. A method for uniformly filling a relatively large container with relatively delicate products using a filling device, comprising:

supplying the products at a first level via a feed conveyor;

transferring the products in a restrained manner from the first level to a second level via a guiding device of the filling device, wherein the guiding device comprises at least one transfer member for receiving the products at a speed adjustable to a speed of the feed conveyer during use, wherein at least one transfer member has a substantially cylindrical form and comprises a plurality of bristles having a first length and a plurality of bristles having a second length;

releasing the products at the second level into a distributing device; and distributing the products into the container.

2. The method of claim 1, wherein the guiding device further comprises:

a guide member, the guide member being arranged substantially along a part of the outside of the transfer member for guiding the products in the transfer member during use.

3. The method of claim 1, wherein the guiding device further comprises a flap extending at least partly along the surface of the transfer member.

4. The method of claim 1, wherein the guiding device further comprises a cleaning member comprising teeth, the teeth extending in at least a portion of the bristles during use.

5. The method of claim 1, wherein the distributing device comprises:

a first rotating distributor comprising flaps for carrying the products during use, wherein the first rotating distributor comprises more flaps on the outer side than on the inner side; and a second distributor arranged below the first rotating distributor and comprising at least one opening for passage of the products.

6. The method of claim 5, wherein the first rotating distributor comprises pins extending substantially as a spoke of the first rotating distributor, and distributing pins extending from the outside to the inside over a part of the first rotating distributor, wherein the flaps can be fixed to these pins.

7. The method of claim 6, wherein the distributing pins are coupled resiliently to the first rotating distributor or take a resilient form.

8. The method of claim 5, wherein the filling device further comprises height-adjusting means for setting the height of the filling device relative to the container.

9. The method of claim 8, wherein the height-adjusting means comprises:

a container displaceable in height, and a height detector for signaling the correct height-adjustment of the container relative to the underside of the distributing device during use.

10. The method of claim 5, wherein the second distributor comprises a distributing flap for distributing the products uniformly and in a gentle manner over the container.

11. The method of claim 5, wherein the filling device further comprises height-adjusting means for setting the height of the container relative to the filling device subject to the level of filling of the container.

12. The method of claim 11, wherein the height-adjusting means comprises means for adjusting the transport angle of the feed conveyor relative to the guiding device.

13. The method of claim 1, wherein the filling device further comprises lifting means for lifting the container.

14. The method of claim 1, wherein the filling device further comprises rotating means for rotating the container.

15. The method of claim 1, wherein the guiding device comprises a long distributing flap.

16. The method of claim 5, further comprising:

stopping at least the second distributor during the filling of the container if there is no supply of fruits.

17. The method of claim 5, further comprising:

varying the speed of at least the second distributor depending on the level of filling of the container.

18. The method of claim 5, wherein supplying the feed conveyor with products comprises filling the feed conveyor gradually or step-wise with a batch of products.

* * * * *